US006997636B2

(12) United States Patent
Tremouilhac

(10) Patent No.: US 6,997,636 B2
(45) Date of Patent: Feb. 14, 2006

(54) DEVICE FOR CONNECTING A PIECE OF ROAD EQUIPMENT, SUCH AS DRAIN INLET, TO A VERTICAL FIXED RUNOFF DRAINAGE PIPE

(75) Inventor: Robert Tremouilhac, Villette de Vienne (FR)

(73) Assignee: Norinco, Saint Crepin Ibouvillers (FR)

( * ) Notice: Subject to any disclaimer, the term of this patent is extended or adjusted under 35 U.S.C. 154(b) by 0 days.

(21) Appl. No.: 10/514,824

(22) PCT Filed: May 28, 2003

(86) PCT No.: PCT/FR03/01619

§ 371 (c)(1),
(2), (4) Date: Nov. 17, 2004

(87) PCT Pub. No.: WO03/102316

PCT Pub. Date: Dec. 11, 2003

(65) Prior Publication Data

US 2005/0207839 A1 Sep. 22, 2005

(30) Foreign Application Priority Data

May 30, 2002 (FR) ..... 02 06635

(51) Int. Cl.
*E01C 11/22* (2006.01)

(52) U.S. Cl. ..... 404/5; 404/2; 404/4; 210/163

(58) Field of Classification Search ..... 404/2, 404/4, 5; 210/163
See application file for complete search history.

(56) References Cited

U.S. PATENT DOCUMENTS

| | | | | |
|---|---|---|---|---|
| 2,938,437 | A * | 5/1960 | Daley | 404/4 |
| 3,703,194 | A * | 11/1972 | Giordano | 138/109 |
| 4,964,180 | A * | 10/1990 | Harbeke | 4/288 |
| 5,299,836 | A * | 4/1994 | Woods | 285/42 |
| 5,722,791 | A * | 3/1998 | Dallmer | 405/52 |
| 5,724,777 | A * | 3/1998 | Hubbard | 52/198 |
| 6,234,711 | B1 | 5/2001 | Beaman | |
| 2003/0037498 | A1 * | 2/2003 | Bishop | 52/302.1 |

FOREIGN PATENT DOCUMENTS

| | | |
|---|---|---|
| GB | 380292 | 9/1932 |

* cited by examiner

*Primary Examiner*—Gary S. Hartmann
(74) *Attorney, Agent, or Firm*—Leydig, Voit & Mayer, Ltd.

(57) ABSTRACT

An apparatus for connection of a drain inlet to a vertical fixed runoff drainage pipe includes an intermediate adapter plate with a cylindrical shank that can be inserted in an impervious manner into a drainage tube at an adjustable relative height. The drain is slidably mounted such that it is guided bilaterally in translation over the plate. In this way, the drain can be disposed at a final determined position in relation to a curb before being sealed to the curb.

9 Claims, 6 Drawing Sheets

1
2
3
5
7
8
13
13
9
14
10
11
6

0
3
F3
1
0
5
2
13
8
7
13
9
F2
11
F1
10
6
14

3
F3
1
5
2
13
8
7
13
F2
9
10
11
F1
6

9
10
11
6

DEVICE FOR CONNECTING A PIECE OF ROAD EQUIPMENT, SUCH AS DRAIN INLET, TO A VERTICAL FIXED RUNOFF DRAINAGE PIPE

FIELD OF THE INVENTION

The present invention concerns a device for connecting a piece of road equipment, such as a drain inlet, to a vertical fixed runoff drainage pipe.

BACKGROUND

The installation of devices known until now for connecting a piece of road equipment to a vertical runoff drainage pipe is not only complex but also poses problems concerning the adjustment of the position of the piece of road equipment with respect to the curb or gutter to which it is to be sealed.

SUMMARY OF THE INVENTION

The present invention aims to eliminate the disadvantages of these known devices by proposing a device for connecting to a vertical fixed runoff drainage pipe a piece of road equipment, such as a drain inlet, which is to be integrated with a curb or gutter, and has a rigid intermediate connecting plate with a central drainage opening, which is connected to a cylindrical barrel extending transversely under the plate coaxially to the opening and which can be engaged in a sealed manner in the vertical pipe or around it at an adjustable relative height, wherein the connecting plate can be oriented relative to the curb or to the gutter by rotation of the barrel in the vertical pipe or around it, and the piece of road equipment is mounted to slide bilaterally, guided in translation on the connecting plate, in the direction of the curb or gutter, thereby allowing the piece of road equipment to be brought into a predetermined definitive position relative to the curb or gutter before sealing the piece of road equipment in the curb or gutter.

The connecting plate is rectangular in shape, and the means for translationally guiding the piece of road equipment on this plate includes two long-armed lateral edges connected to the piece of equipment at the lower part of its rectangular frame and at least two pieces in the form of slideways respectively connected to the two sides of the connecting plate in such a way that the two lateral edges can slide into the two pieces in the form of slideways.

An elastomer seal is inserted between the barrel of the connecting plate and the vertical drainage pipe.

The seal is connected to the free end of the vertical pipe while covering it and has a sealing lip inserted between the barrel and the vertical drainage pipe.

When the barrel of the connecting plate is mounted around the vertical drainage pipe, the seal can be connected to the free end of this barrel while covering it and have a sealing lip inserted between the barrel and the vertical drainage pipe.

The central opening of the connecting plate is frustrum-shaped to form a funnel for drainage of runoff water.

Advantageously, a mud collection container is housed in the barrel of the connecting plate and supported on the frustrum-shaped central opening of this plate.

Preferably, two pieces in the form of slideways are provided which are located at intervals along each side of the connecting plate.

Each piece in the form of a slideway is made up of a small bent plate having a cross section in the form of a U, one of the arms of which is attached to the connecting plate in the plane thereof, with the other arm extending parallel above this plate.

BRIEF DESCRIPTION OF DRAWINGS

The invention will be better understood and its other aims, characteristics, details and advantages will appear more clearly in the following explanatory description with reference to the diagrammatic drawings given only by way of example and in which.

DETAILED DESCRIPTION

Figure 1:
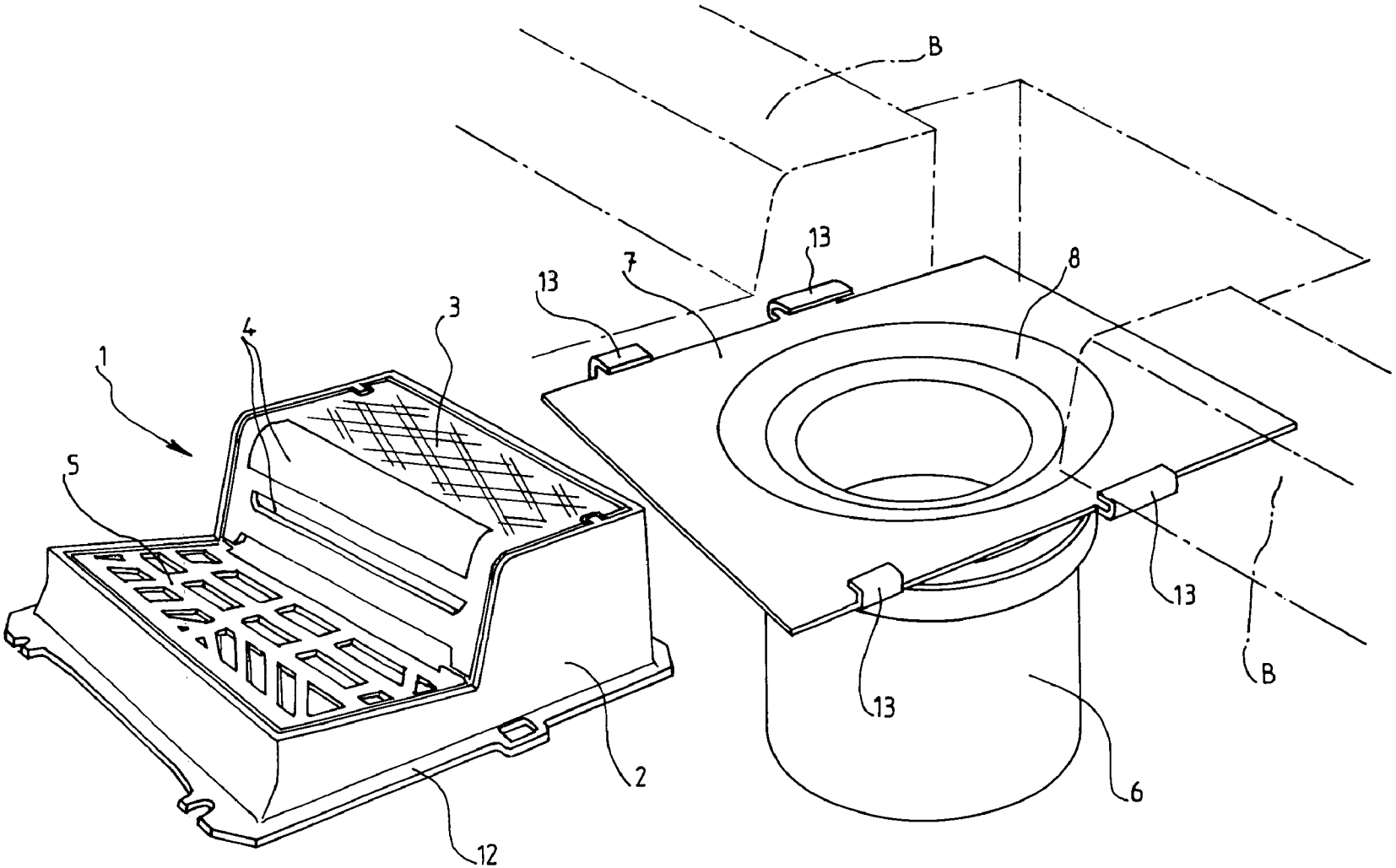
FIG. 1 is an exploded perspective view of the device of the invention for connecting a piece of road equipment to a vertical fixed runoff drainage pipe.
Figure 2:
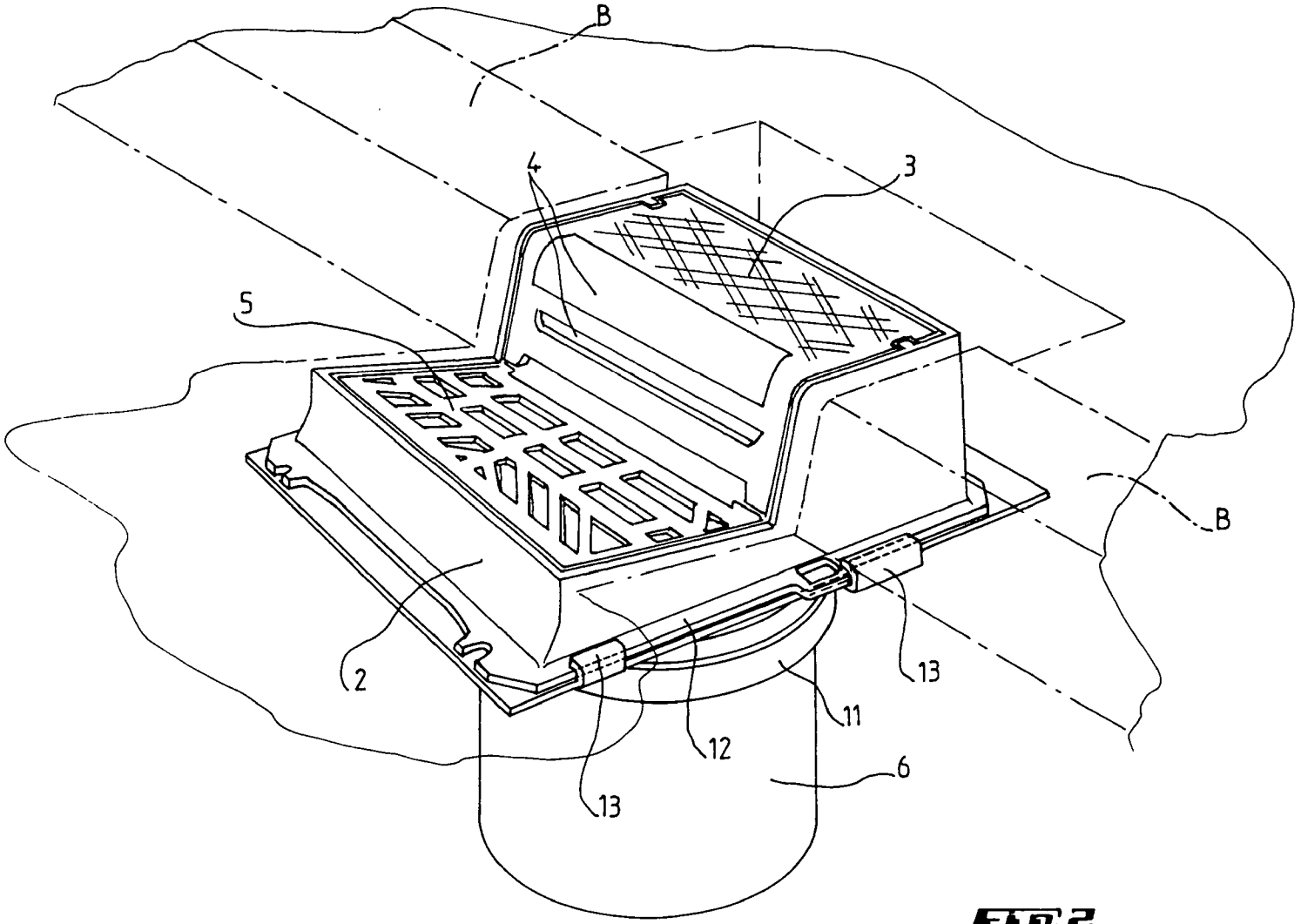
FIG. 2 is a perspective view of the piece of road equipment of FIG. 1 in definitive position before it is sealed in a curb.

The invention will now be described with reference to a drain inlet device which is to be integrated with a curb after it is connected to a runoff drainage pipe, but it is understood that it can also be applied to any other type of road equipment, such as a rectangular grate for runoff drainage, which is to be integrated with elements besides curbs, such as gutters, for example.

With reference to the figures, reference numeral 1 designates a drain inlet device, which is already known, and which is to be integrated with beveled curb B of the sidewalk.

This drain inlet device is of the type which has a generally rectangular frame 2, which comprises, at the top, articulated buffer 3 normally locked to frame 2 and provided with at least one slot 4 for the passage of runoff water, and at the lower part, grate 5 for the passage of runoff water, articulated to frame 2 while being normally locked to it. The drain inlet device, with its buffer 3 and grate 5, has a configuration in the form of a step allowing it to be integrated with curb B. Buffer 3 and grate 5 can be unlocked and opened in the direction indicated by each of the arrows 0 in FIG. 6 in order to access the interior of frame 2.

Drain inlet device 1 is connected to vertical runoff drainage pipe 6 penetrating into frame 2 towards the drain with which pipe 6 communicates. The latter is implanted in the ground or attached to it by any appropriate means a certain distance from curb B, and its free external upper part is located below the curb.

According to the invention, the device for connecting drain inlet 1 to drainage pipe 6 includes rigid intermediate connecting plate 7, rectangular in shape, which has frustrum-shaped central opening 8 forming a funnel for drainage of the runoff water, and cylindrical barrel 9 attached under connecting plate 7, extending perpendicularly to it and coaxially to central opening 8. Barrel 9 can be attached to plate 7 by welding.

Figure 6:
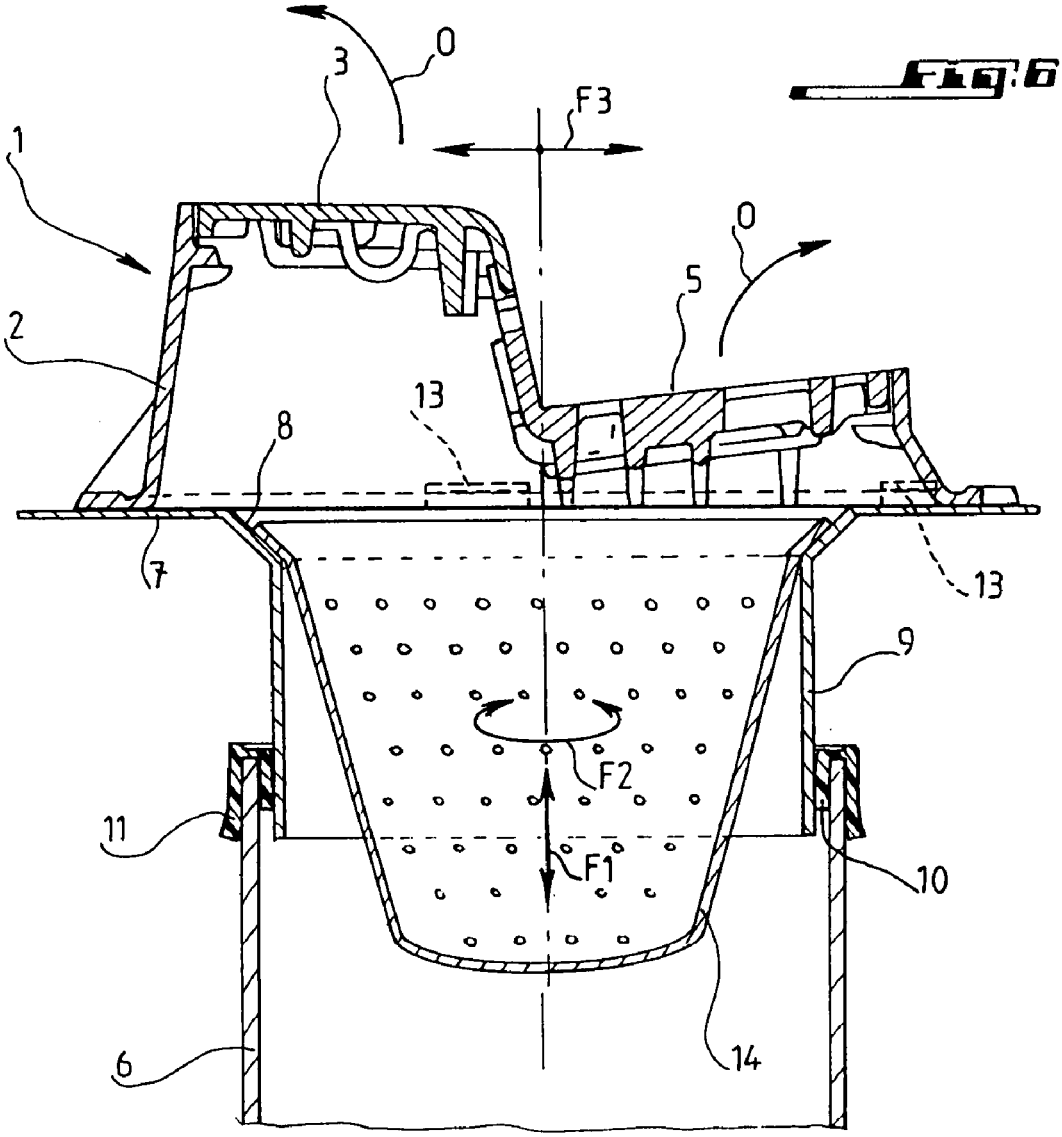
FIG. 6 is a view similar to that of FIG. 5, representing the connecting plate on which the piece of road equipment is mounted and which is assembled on the drainage pipe.
Figure 7:
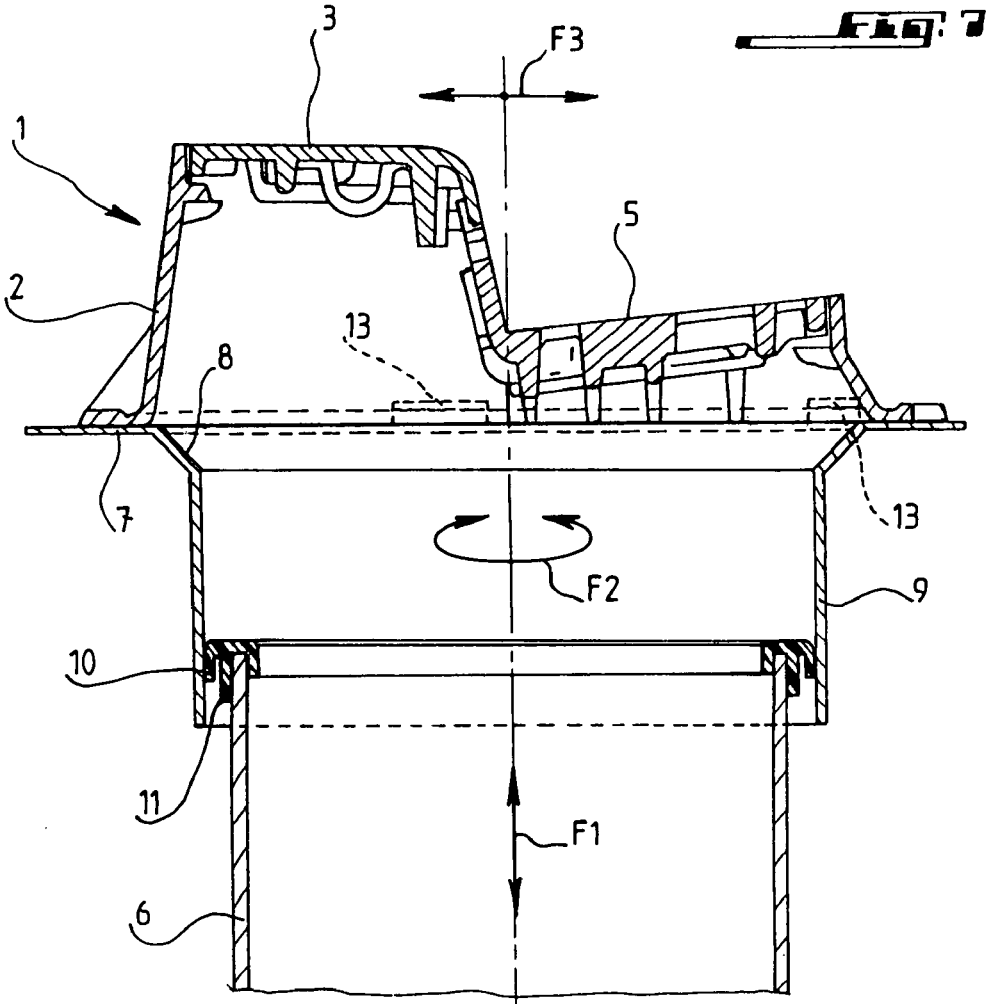
FIG. 7 shows a section similar to that of FIG. 6 and represents an embodiment in which the connecting plate is mounted around the drainage pipe.
Figure 8:
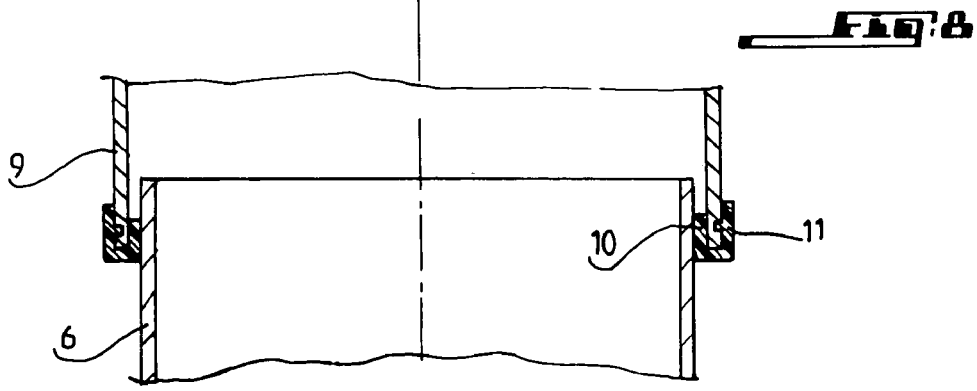
FIG. 8 is a partial cross section of an embodiment variant of FIG. 7.

Barrel 9 of plate 7 can be engaged in a sealed manner in cylindrical pipe 6 as is shown more clearly in FIG. 6, at a relative height which is adjustable according to the direction symbolized by the double arrow F1, or mounted in a sealed manner around cylindrical pipe 6 as represented in FIGS. 7 and 8, at a relative height which is adjustable according to the direction also indicated by the double arrow F1.

Figure 5:
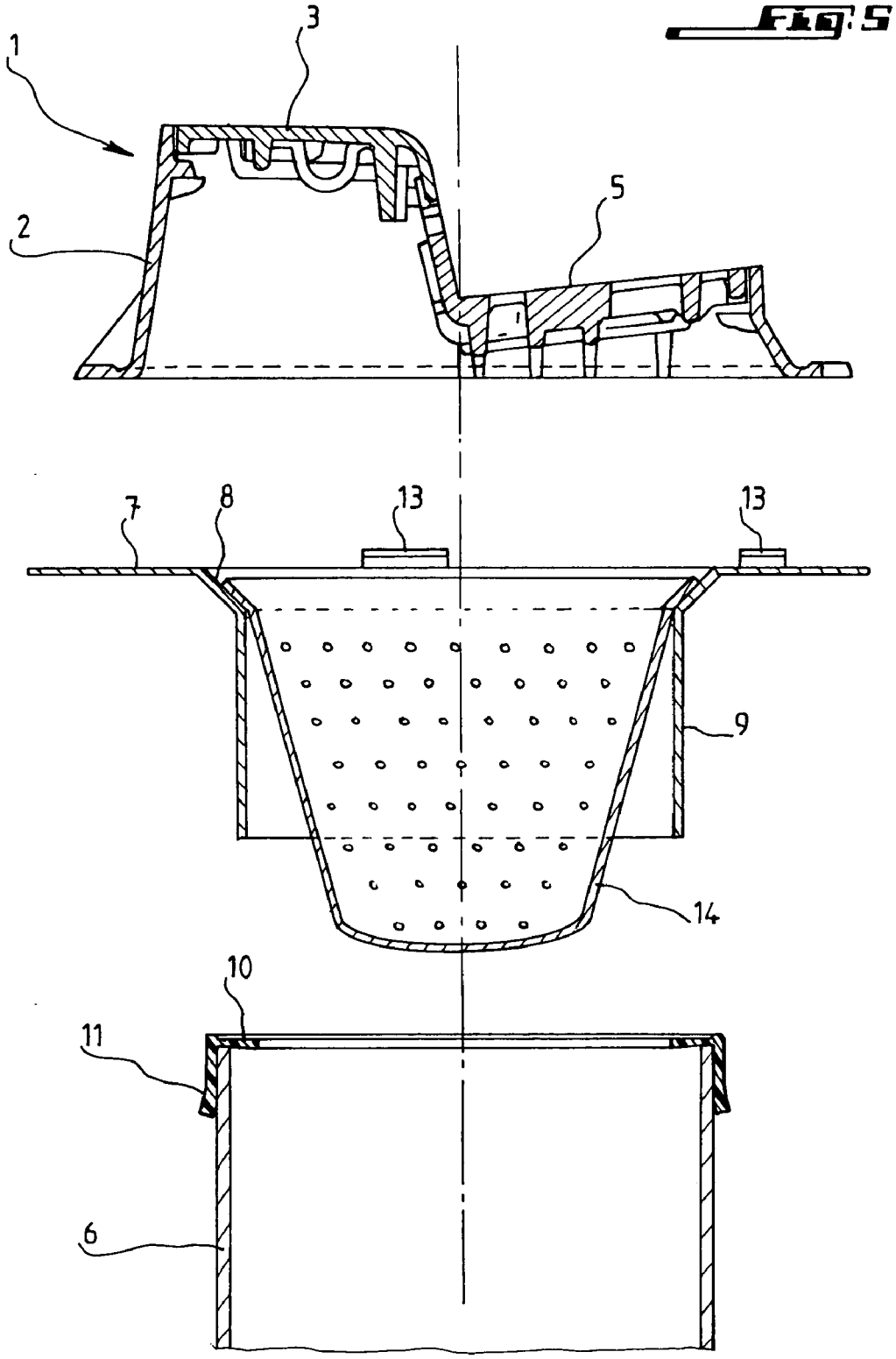
FIG. 5 shows a section through the longitudinal vertical medial plane of the assembly consisting of the piece of road equipment, the connecting plate and the vertical drainage pipe arranged separately one above the other.

The seal between cylindrical barrel 9 and cylindrical pipe 6 is ensured by elastomer seal 10. According to the configuration in which barrel 9 is fitted into pipe 6, seal 10 is mounted on the upper free end of pipe 6 and covers it. For this purpose, seal 10 can have roughly cylindrical external skirt 11 which fits around the upper part of pipe 6. In the position in which seal 10 is mounted on pipe 6 before fitting of barrel 9 in pipe 6, seal 10 has at rest an annular internal lip, approximately transverse to the longitudinal axis of pipe 6, as represented in FIG. 5. During the fitting of barrel 9 in pipe 6, lip 10 is folded down by barrel 9 onto the upper cylindrical internal surface of pipe 6, as represented in FIG. 6, in order to provide a seal between barrel 9 and pipe 6. In the case in which barrel 9 is fitted around cylindrical pipe 6 as represented in FIG. 7, seal 10 is also attached on the upper free end of pipe 6, covering it with roughly cylindrical skirt 11 surrounding pipe 6, and it has an external lip constituting the actual seal, annular in shape, approximately transverse to the longitudinal axis of pipe 6 before mounting of barrel 9 around this pipe. When barrel 9 is fitted around pipe 6, sealing lip 10 is folded down by barrel 9 to a position roughly parallel to the longitudinal axis of pipe 6 in order to constitute a cylindrical seal between barrel 9 and pipe 6. FIG. 8 shows an embodiment of FIG. 7, according to which seal 10 is attached at the end of barrel 9 and covers it, and its annular sealing lip is folded down on the internal surface of barrel 9 when it fitted in pipe 6.

When barrel 9 is inserted in pipe 6 or mounted around it, connecting plate 7 can be maneuvered manually in order not only to move it vertically relative to pipe 6 according to the direction of the double arrow F1, but also to rotate it around the vertical axis of pipe 6 as indicated by the double arrow F2 in FIGS. 6 and 7, so as to adjust the height of connecting plate 7 and orient it angularly relative to curb B.

Furthermore, drain inlet 1 can be mounted so as to slide bilaterally, translationally guided on connecting plate 7, in the direction of curb B, as symbolized by the double arrow F3 in FIGS. 6 and 7, so that drain inlet 1 can thus be brought into a predetermined definitive position relative to curb B by a combination of movements according to arrows F1 to F3, before sealing drain inlet 1 to this curb.

The means of translationally guiding drain inlet 1 on connecting plate 7 include two long-armed lateral edges 12 connected to the lower part of frame 2 of drain inlet 1 and at least two pieces in the form of slideways 13 respectively connected on the two sides of connecting plate 7 in such a way that the two lateral edges 12 can slide into the two pieces in the form of slideways 13. Preferably, each side of connecting plate 7 has two pieces in the form of slideways separated along this side. Each piece in the form of a slideway can consist of a small plate bent so as to have a cross section in the form of a U, one of the arms of which is connected to plate 7 extending roughly in the same plane, and the opposite arm is arranged in parallel over plate 7. Of course, each piece in the form of a slideway can have a different configuration, for example, in the form of a corner bracket, one of the arms of which would be orthogonally connected to plate 7, and the other arm would extend parallel above plate 7.

As represented in FIGS. 5 and 6, connecting plate 7 can support mud collecting container 14 housed in barrel 9 and held in this barrel by its upper frustrum-shaped edge resting on conjugately shaped frustrum-shaped opening 8 of plate 7.

The connection of drain inlet 1 to drainage pipe 6 takes place as follows.

Figure 3:
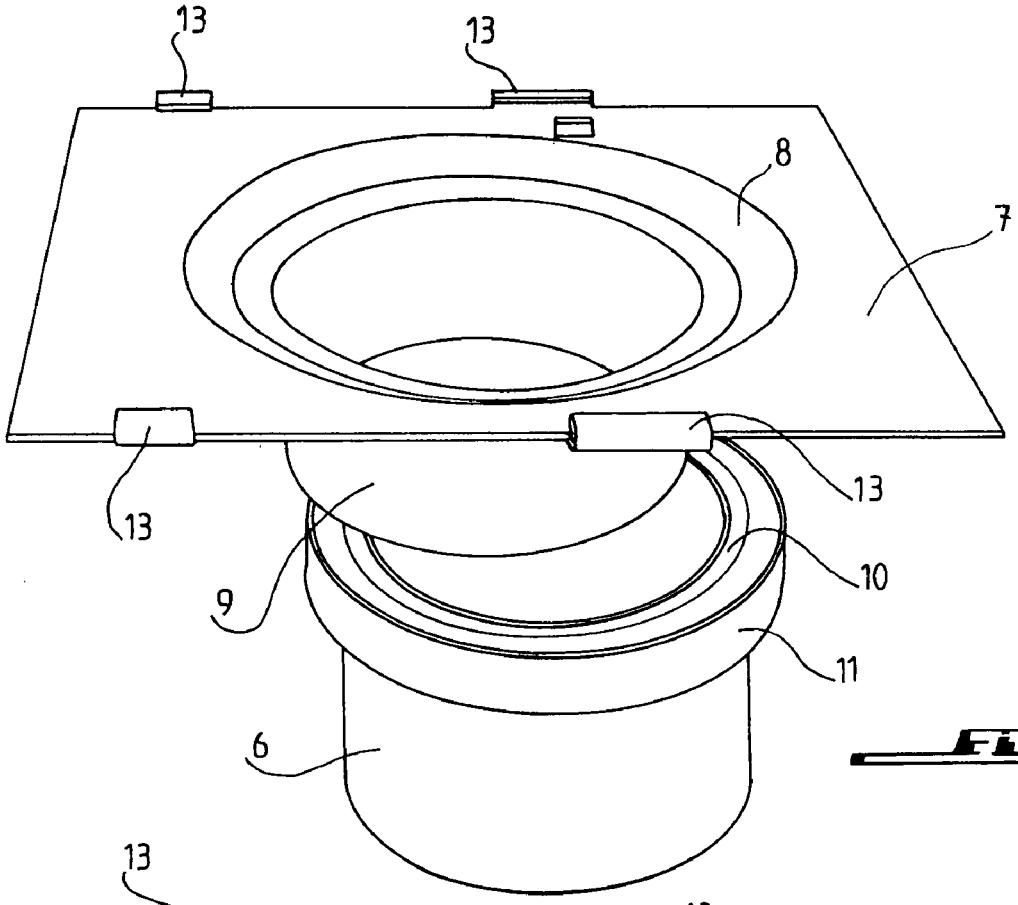
FIG. 3 is an exploded perspective view of a connecting plate of the connecting device of the invention before it is mounted in the vertical drainage pipe.
Figure 4:
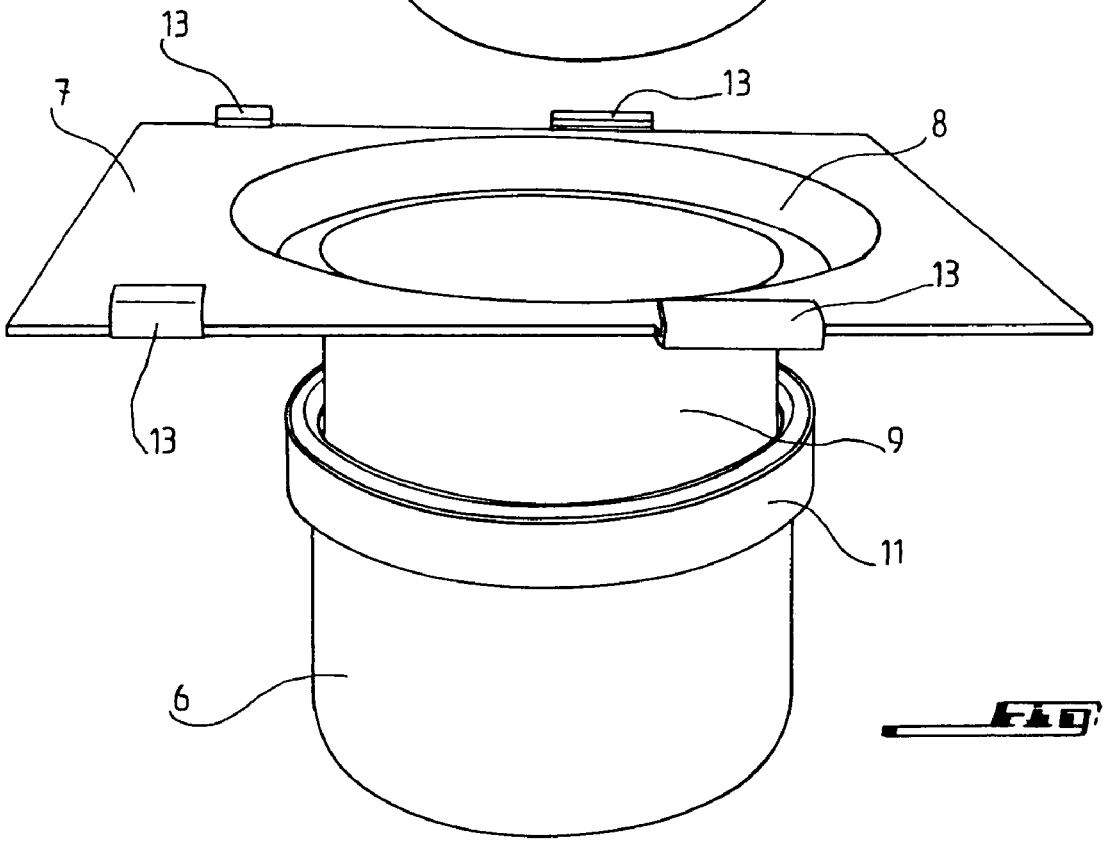
FIG. 4 is a perspective view similar to that of FIG. 3, representing the connecting plate mounted in the drainage pipe.

First, the operator takes hold of connecting plate 7 in order to position cylindrical barrel 9 over drainage pipe 6 and engage it therein, as represented in FIGS. 3 and 4, which enables the operator to position barrel 9 and therefore plate 7 at a relative height by taking into account the vertical position of plate 7 relative to curb B; this plate can also be oriented by rotation relative to pipe 6 in order to position it along a direction roughly transverse with respect to curb B.

The operator then takes hold of drain inlet 1 and arranges it on plate 7 by introducing its lateral edges 12 into their respective guide slideways 13 and allows drain inlet 1 to slide in a guided manner on plate 7 in a roughly transverse direction with respect to curb B until drain inlet 1 is brought to its definitive position where it can be sealed in curb B by the usual sealing techniques.

It should be noted that plate 7, once it is correctly positioned relative to curb B, can be sealed relative to it before introducing drain inlet 1 on plate 7 in order to position it relative to curb B and to seal it to the latter.

The connection of drain inlet 1 can also take place by fitting it in a guided manner on plate 7 and arranging this assembly on drainage pipe 6 by introducing barrel 9 in the latter, if it is possible to position this assembly precisely in a single step relative to curb B before sealing of this assembly.

The connecting device of the invention described above has an extremely simple structure and allows drain inlet 1 to be positioned precisely and quickly before sealing it in curb B. As an indication, for an external diameter of drainage pipe 6 of approximately 400 mm, the possibility for height adjustment according to arrow F1 of barrel 9 relative to this pipe can extend over approximately 150 mm, and the extent of the adjustment of the position of drain inlet 1 on plate 7 according to the double direction F3 can be 100 mm; that is, drain inlet 1 can occupy a rear position located to the left in FIG. 6 or 7 a maximum of 50 mm with respect to the longitudinal axis of pipe 6 and a front position located to the right in this figure a maximum of 50 mm from this longitudinal axis. Thus, the connecting device of the invention allows very extended possibilities for adjustment in order to adapt to all configurations of positioning of drainage pipe 6 relative to curb B. Although the drain inlet is usually fabricated from cast iron, it can be made of any other material, such as a rigid plastic material, as can connecting plate 7 and its barrel 9. In this case, the assembly consisting of plate 7, barrel 9 and slideways 13 will be produced in the form of a single piece by molding.

What is claimed is:

1. An apparatus for connecting to a vertical fixed runoff drainage pipe a drain inlet which is to be integrated with a curb or gutter, the apparatus comprising:

a rigid intermediate connecting plate including a central drainage opening having a central axis and a cylindrical barrel extending transversely from the plate, coaxially with the opening, for sealed engagement to a vertical pipe, adjustable along the axis and rotatable about the axis for orientation relative to a curb or gutter; and means for, translationally guiding the connecting plate, for bilateral sliding along the curb or gutter transverse to the central axis, for definitive positioning relative to the curb or gutter before sealing in the curb or gutter.

2. The apparatus according to claim 1, wherein the connecting plate is rectangular in shape, and the means for translationally guiding the plate includes two long-armed lateral edges connected to the drain inlet at a lower part of a rectangular frame of the drain inlet and at least two slideways connected respectively to sides of the connecting plate so the two lateral edges can slide in the slideways.

3. The apparatus according to claim 1, including an elastomer seal inserted between the barrel of the connecting plate and vertical drainage pipe.

4. The apparatus according to claim 3, wherein the seal is connected to a free end of the vertical drainage pipe, covers the free end, and includes a sealing lip inserted between the barrel of the connected plate and the vertical drainage pipe.

5. The apparatus according to claim 3, wherein the seal is connected to a free end of the barrel and covers the free end of the barrel when the barrel is mounted around and outside the drainage pipe, and includes a sealing lip located between the barrel and the drainage pipe.

6. The apparatus according to claim 1, wherein the central opening of the connecting plate is frustrum-shaped, forming a funnel for drainage of runoff water.

7. The apparatus according to claim 6, including a mud collection container is housed in the barrel and supported on the frustrum-shaped central opening of the connecting plate.

8. The apparatus according to claim 7, wherein the two slideways are located at intervals along each side of the connecting plate.

9. The apparatus according to claim 8, wherein each slideway includes a bent plate having a cross-section in the form of a U, having a first arm connected to and co-planar with the connecting plate, and a second arm extending parallel to and spaced from the connecting plate.

* * * * *